US006262533B1

(12) United States Patent
Niimi

(10) Patent No.: US 6,262,533 B1
(45) Date of Patent: Jul. 17, 2001

(54) STARTING ELECTRODE FOR HIGH PRESSURE DISCHARGE LAMP

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/268,967

(22) Filed: Mar. 16, 1999

(30) Foreign Application Priority Data

Mar. 18, 1998 (JP) ..... 10-068413

(51) Int. Cl.[7] ..... H01J 17/30
(52) U.S. Cl. ..... 313/601; 313/311
(58) Field of Search ..... 313/601, 246, 313/331, 625, 311, 633, 217, 623

(56) References Cited

U.S. PATENT DOCUMENTS

| | | | | |
|---|---|---|---|---|
| 3,848,151 | * | 11/1974 | McVey | 313/601 |
| 4,052,635 | | 10/1977 | Jacobs . | |
| 4,191,910 | | 3/1980 | Larson . | |
| 4,207,499 | | 6/1980 | Tam et al. . | |
| 4,437,039 | * | 3/1984 | Larson | 313/331 |
| 4,602,956 | | 7/1986 | Partlow et al. . | |
| 4,881,009 | | 11/1989 | Passmore . | |
| 5,834,985 | * | 11/1998 | Dolan et al. | 313/570 |

FOREIGN PATENT DOCUMENTS

| | | | | |
|---|---|---|---|---|
| 0 028 128 | | 10/1980 | (EP) . | |
| 1421406 | | 4/1973 | (GB) . | |
| 1382934 | * | 2/1975 | (GB) | 313/331 |
| 1421406 | | 1/1976 | (GB) . | |
| 2071907A | | 9/1981 | (GB) . | |

* cited by examiner

*Primary Examiner*—Ashok Patel
*Assistant Examiner*—Todd Reed Hopper
(74) *Attorney, Agent, or Firm*—Burr & Brown

(57) ABSTRACT

A high pressure discharge lamp comprises a vessel made of a non-conductive material which forms an inner space filled with an ionizable light-emitting material and a starting gas, the vessel having first and second opening portions at both ends thereof, and a non-conductive member inserted into the first opening portion of the vessel and having an outer diameter which is smaller than the inner diameter of the first opening portion so as to form a gap between the vessel and the non-conductive member, the non-conductive member further having a hole. An electrode unit is inserted into the hole of the non-conductive member, the electrode unit has a first end which is exposed to the inner space of the vessel, and a second end which is exposed to outside of the vessel. An starting electrode is arranged in the gap between the vessel and the non-conductive member, and has a first end which is exposed to the inner space, and a second end which is exposed to outside of the vessel. The vessel, the non-conductive member and the starting electrode are an integrated body which has been formed by a co-firing process.

13 Claims, 20 Drawing Sheets

STARTING ELECTRODE FOR HIGH PRESSURE DISCHARGE LAMP

BACKGROUND OF THE INVENTION

1. Field of the Invention

The present invention relates to a high pressure discharge lamp such as a sodium-vapor lamp, a metal halide lamp or the like.

2. Background Art

Conventionally, a high pressure discharge lamp includes a vessel made of a non-conductive material which forms an inner space filled with an ionizable light-emitting material and a starting gas, the vessel having first and second opening portions at both ends thereof, and a non-conductive member inserted into the first opening portion of the vessel and having an outer diameter which is smaller than inner diameter of the first opening portion so as to form a gap between the vessel and the non-conductive member, the non-conductive member further having a hole. An electrode unit is inserted into the hole of the non-conductive member. The electrode unit has a first end which is exposed to the inner space of the vessel, and a second end which is exposed to outside of the vessel.

In this connection, GB-A-1421406, JP-U-52-19182 and U.S. Pat. No. 5,541,480 each discloses such a high pressure discharge lamp which is further provided with at least one starting electrode which serves to reduce the starting voltage.

In the high pressure discharge lamp according to GB-A1421406, the non-conductive member is in the form of a ring which is inserted into a gap between an envelope and a cap, and a metal layer is provided on an inner face of the ring and acts as a starting electrode. In this instance, since the ring is arranged between the envelope and the cap, it is necessary to seal the gap between the envelope and the ring, and also seal the gap between the ring and the cap. Such a structure is not very appropriate from the viewpoint of the corrosion resistance and the tightness property.

In the high pressure discharge lamp according to JP-U-52-19182 and U.S. Pat. No. 5,541,480, a linear conductive material such as carbon, platinum, palladium or the like is provided on a light-emitting portion thereof. This structure is not very appropriate because such a conductive material tends to decrease the luminous flux of the lamp.

DISCLOSURE OF THE INVENTION

It is an object of the present invention to provide a high pressure discharge lamp which has excellent corrosion resistance and tightness properties without reducing the luminous flux.

According to the present invention of the high pressure discharge lamp, there is provided a high pressure discharge lamp comprising: a vessel made of a non-conductive material which forms an inner space filled with an ionizable light-emitting material and a starting gas, the vessel having first and second opening portions at both ends thereof, a non-conductive member inserted into the first opening portion of the vessel and having an outer diameter which is smaller than inner diameter of the first opening portion so as to form a gap between the vessel and the non-conductive member, the non-conductive member further having a hole; an electrode unit inserted into the hole of the non-conductive member, the electrode unit having a first end which is exposed to the inner space of the vessel, and a second end which is exposed to outside of the vessel; and an starting electrode arranged in the gap between the vessel and the non-conductive member, and having a first end which is exposed to the inner space, and a second end which is exposed to outside of the vessel; the vessel, the non-conductive member and the starting electrode being an integrated body which has been formed by a co-firing process.

According to the invention, the starting electrode is arranged in the gap between the vessel and the non-conductive member, it has a first end which is exposed to the inner space and a second end which is exposed to outside of the vessel, the vessel, the non-conductive member and the starting electrode is an integrated body which has been formed by a co-firing process. Therefore, it is not necessary to provide another member when the starting electrode is provided and seals the gap therebetween, so that the discharge lamp according to the invention has excellent corrosion resistance and tightness properties. Also, as carbon, platinum, palladium or the like is not provided on an outer surface of a light-emitting portion thereof the luminous flux thereof does not decrease. Moreover, such a integrated body makes a strongly jointed structure thereamong. As used in the embodiment, the phrase "the non-conductive member" includes a capillary, a disc or both of them.

Preferably, the starting electrode is composed of a metal.

By composing the starting electrode of a metal, a good conductivity thereof the connection between the starting electrode and an outer circuit, and a good discharge by the starting electrode are realized.

The starting electrode can also be composed of a mixture of a non-conductive material and a metal.

By composing the starting electrode by the mixture, the non-conductive material in the vessel and the non-conductive member is diffused into the mixture when having been subjected to a co-firing into an integrated body, so that a strongly jointed structure is formed among the starting electrode, the vessel and the non-conductive member. Therefore, the present invention yields a discharge lamp having full tightness characteristics while maintaining full conductivity.

More preferably, the mixture contains 30 to 70 volumetric percentage of a metal.

As the volumetric percentage of a metal increases, the conductivity of the starting electrode improves. On the other hand, as the volumetric percentage of a non-conductive material increases, the tightness property of the discharge lamp improves. To compromise these properties, it is found that 30 to 70 volumetric percentage of a metal is preferable.

More preferably, the metal of the mixture contains not less than 50 volumetric percentage of molybdenum; and the non-conductive material of the mixture contains not less than 50 volumetric percentage of the material from which the vessel and/or the non-conductive member is formed.

To form a strongly jointed structure among the starting electrode, the vessel and/or the non-conductive member, it is necessary to select a metal having a melting point near that of the non-conductive material which composes the vessel and/or the non-conductive member, and a high halogen resistance. Also, the non-conductive material of the mixture used to make up the starting electrode should be formed of the material which the vessel and/or the non-conductive member is formed. To fulfill such requirements, the metal contains not less than 50 volumetric percentage of molybdenum which has a high halogen resistance and a comparatively low melting point (2623° C.), and the non-conductive material contains not less than 50 volumetric percentage of the material from which the vessel and/or the non-conductive material is formed.

More preferably, the metal of the mixture forming the starting electrode comprises molybdenum, and the non-conductive material of the mixture is the same as the non-conductive material for said vessel and said non-conductive member.

To form a strongly jointed structure among the starting electrode, the vessel and/or the non-conductive member, it is preferable that the volumetric percentage of molybdenum in the metal be as high as possible, and that of the non-conductive material which the vessel and/or the non-conductive member is formed, also be as high as possible. Therefore, it is preferred that the mixture comprises molybdenum and the material which the vessel and the non-conductive member are formed.

As used herein, the word "molybdenum" includes not only pure molybdenum, but also molybdenum which contains a small amount of impurities. Also, the phrase "material which the vessel and the non-conductive material are formed" not only the pure material which the vessel and non-conductive member are formed but also a material which contains a small amount of impurities.

Further, the starting electrode may comprise an exposed portion which is exposed to either the inner space or outside of said vessel, and which is composed of a metal, and a non-exposed portion of the starting electrode which is not exposed to said inner space or outside of said vessel, and which is composed of a mixture of a non-conductive material and a metal.

Such an starting electrode can form a strongly jointed structure among the starting electrode, the vessel and the non-conductive member, so that the discharge lamp according to the invention has a full tightness property while maintaining full conductivity, thus a good connection between the starting electrode and an outer circuit can be performed and a good discharge by the starting electrode is realized.

More preferably, the mixture contains 30 to 70 volumetric percentage of a metal.

As the volumetric percentage of a metal increases, the conductivity of the starting electrode improves. On the other hand, as the volumetric percentage of a non-conductive material increases, the tightness property of the discharge lamp improves. To compromise these properties it is found that 30 to 70 volumetric percentage of a metal is preferable.

More preferably, the metal of the mixture contains not less than 50 volumetric percentage of molybdenum; and the non-conductive material of the mixture contains not less than 50 volumetric percentage of the material from which the vessel and/or the non-conductive member is formed.

To form a strongly jointed structure among the starting electrode, the vessel and/or the non-conductive member, it is necessary to select a metal having a melting point near that of the non-conductive material which composes the vessel and/or the non-conductive member, and a high halogen resistance. Also, the non-conductive material needs to be formed by the material which the vessel and/or the non-conductive member is formed. To fulfill such requirements, the metal contains not less than 50 volumetric percentage of molybdenum which has a high halogen resistance and a comparatively low melting point (2623° C.), and the non-conductive material contains not less than 50 volumetric percentage of the material from which the vessel and/or the non-conductive member is formed.

More preferably, the metal of the mixture forming the starting electrode comprises molybdenum, and the non-conductive material of the mixture is the same as the non-conductive material for the vessel and the non-conductive member.

To form a strongly jointed structure among the starting electrode the vessel and/or the non-conductive member, it is preferable that the volumetric percentage of molybdenum in the metal be as high as possible, and that of the non-conductive material which the vessel and/or the non-conductive member is formed, also be as high as possible. Therefore, it is preferred that the mixture comprises molybdenum and the material which the vessel and the non-conductive member are formed.

DESCRIPTION OF THE PREFERRED EMBODIMENTS

Figure 1:
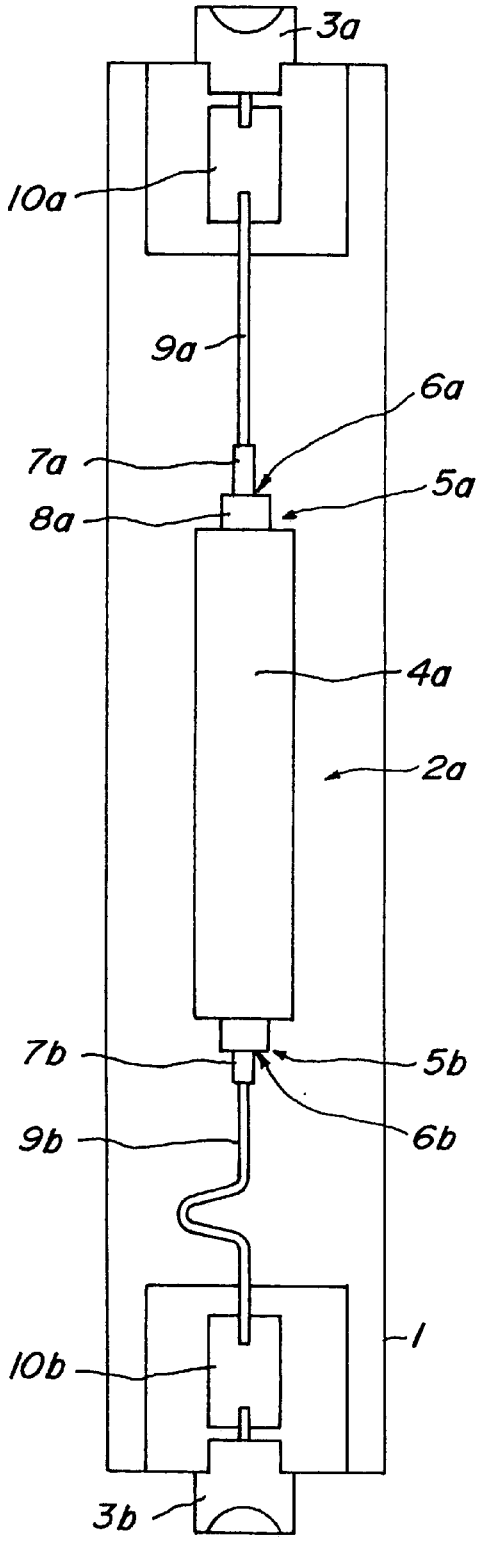
FIG. 1 is a schematic view showing a first embodiment of the high pressure discharge lamp according to the present invention.

The embodiments of the high pressure discharge lamp according to the present invention will be explained with reference to the drawings. In the drawings, the same reference number refers to the same member.

FIG. 1 is a plane view for schematically showing the first embodiment of the entire structure of the high pressure discharge lamp. A ceramic discharge tube 2*a* is placed in outer tube 1 made of quartz glass or hard glass, and the center axis of the outer tube 1 is accurately aligned with that of the ceramic discharge tube 2*a*.

Both ends of the outer tube 1 are tightly sealed with respective caps 3*a*, 3*b*. The ceramic discharge vessel 2*a* comprises a tubular vessel 4*a* made of alumina, capillaries 6*a*, 6*b* made of alumina form the non-conductive body which is provided at both ends 5*a*, 5*b* of the tubular vessel 4*a*, respectively, and composite electrodes 7*a*, 7*b* inserted into the capillaries 6*a*, 6*b* so that one end thereof is exposed to the inner space of the tubular vessel 4*a* and the other end thereof is exposed to outside of the tubular vessel 4*a*, respectively.

In this embodiment, the tubular vessel 4*a*, the capillary 6*a* and a starting electrode 8*a* are an integrated body which has been formed by a co-firing process, with the starting electrode 8*a* arranged in a gap between the tubular vessel 4*a* and the capillary 6*a* such that a first end is exposed to the inner space of the tubular vessel 4*a*, a second end is exposed to outside of the tubular vessel 4*a* and the tubular surface of the capillary 6*a* is metallized.

The starting electrode 8*a* is composed of a mixture of alumina and molybdenum. The mixture contains 30 to 70 volumetric percentage of molybdenum.

The ceramic discharge tube 2*a* is held by the outer tube 1 via two lead wires 9*a*, 9*b*. The lead wires 9*a*, 9*b* are connected to the respective caps 3*a*, 3*b* via respective foils 10*a*, 10*b*. In this case, the starting electrode 8*a* is also connected to the cap 3*a* via a lead wire (not shown).

Figure 2:
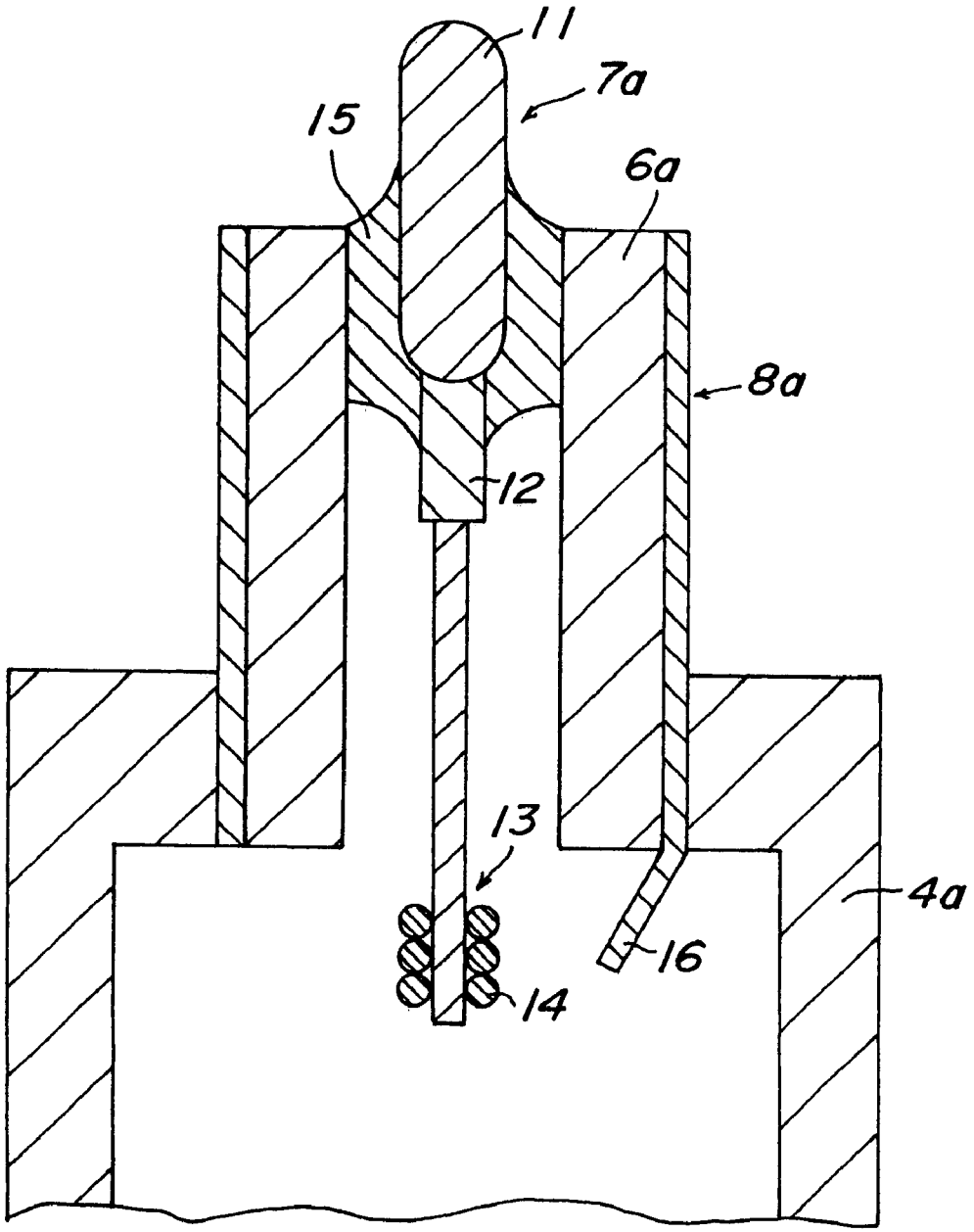
FIGS. 2 to 9 are sectional views showing, in enlarged scale, various examples of one end portion of the vessel in the first embodiment of the present invention.

FIG. 2 is a sectional view showing, in an enlarged scale, a first example of one end portion of the vessel in the first embodiment of the present invention. In FIG. 2 the composite electrode 7*a* comprises a substantially cylindrical member 11 made of niobium with a diameter smaller than an inner diameter of the capillary 6*a*, a cylindrical member 12 made of molybdenum with a diameter smaller than that of the substantially cylindrical member 11, the cylindrical member 12 has a first end which is jointed on the bottom of the substantially cylindrical member 11 exposed to the inner space of the tubular vessel 4*a*, and a second end which is jointed an electrode 13. The electrode 13 has a coil 14. A gap between the composite electrode 7*a* and a non-conductive member (i.e. the tubular vessel 4*a* and the capillary 6*a*) is tightly sealed by filling with frit seal 15. The end 5*b* (FIG. 1) has the same construction except that the tubular vessel 4*a*, the capillary 6*a* and an starting electrode 8*a* are an integrated body which has been formed by a co-firing process.

In such a discharge lamp, discharge occurs between the composite electrode 7*a* and a protrusion 16 when the discharge lamp is ignited, where the protrusion 16 protrudes into the inner space of the tubular vessel 4*a* so that the protruding direction thereof crosses the central axis of the tubular vessel 4*a*. As a result, the starting voltage of the discharge lamp is reduced due to the discharge.

According to the embodiment, a sealant means such as a frit seal is not necessary when the starting electrode 8*a* is provided, and the discharge lamp has excellent corrosion resistance and a tight fitting property. Further, carbon, platinum, palladium or the like is not provided on the tubular surface of the ceramic tube, so that the illuminance thereof does not decrease. Moreover, the tubular vessel 4*a*, capillary 6*a* and the starting electrode 8*a* are an integrated body formed by a co-firing process, so that such an integrated body makes a strongly jointed structure thereamong.

Figure 3:
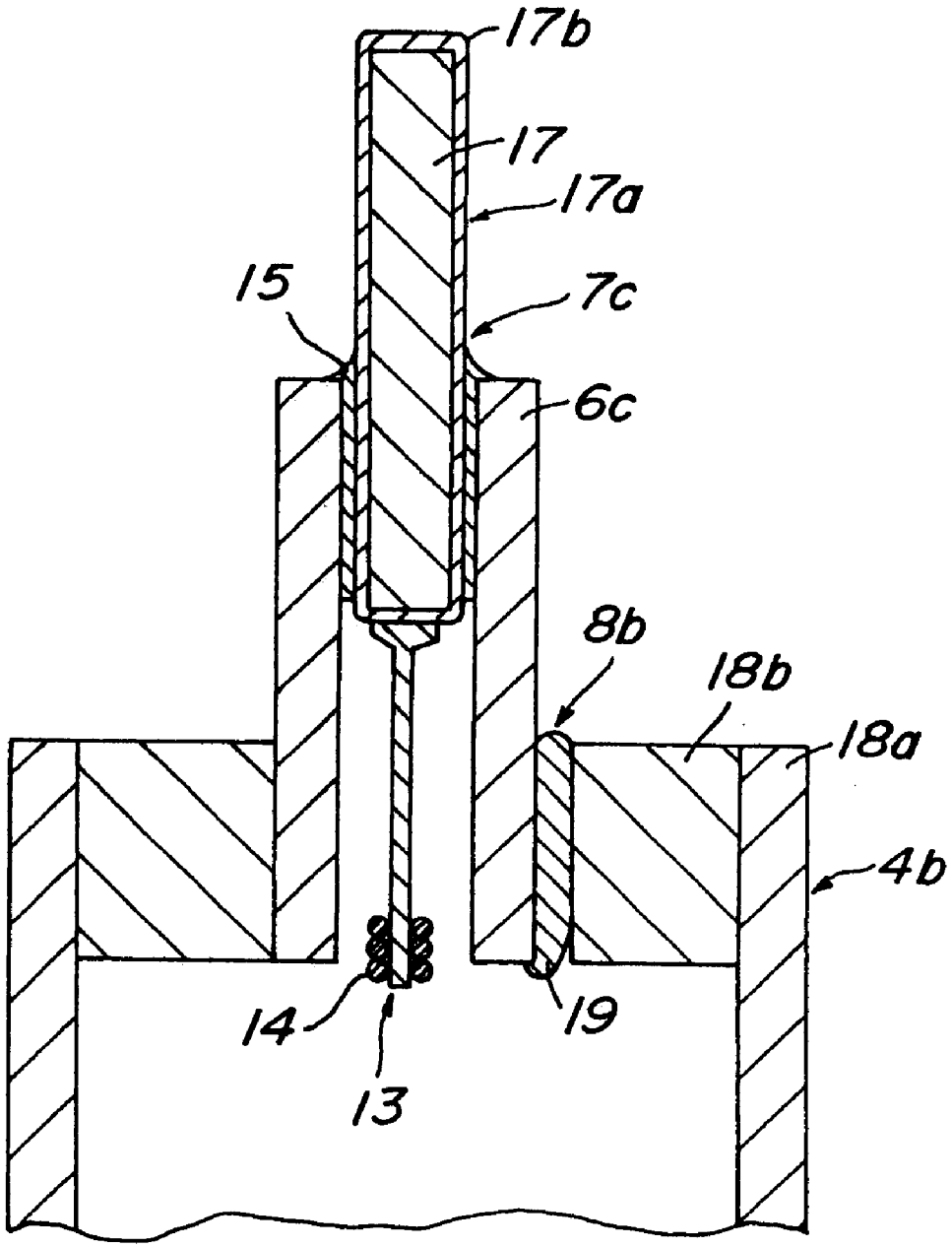

FIG. 3 is a sectional view showing, in enlarged scale, a second example of one end portion of the vessel in the first embodiment of the present invention. In FIG. 3, a composite electrode 7*c* comprises a current conductor 17, and electrode 13 jointed by welding at a bottom of the current conductor 17 exposed to the inner space of a tubular vessel 4*b*. The current electrode 17 has a cylindrical member 17*a* made of alumina, and a metallizing layer 17*b* made of the mixture of alumina and molybdenum.

A gap between the composite electrode 7*c* and a capillary 6*c* is tightly sealed by filling a frit seal 15. The tubular vessel 4*b* has a main body 18*a* and a disc 18*b*.

In the embodiment, the tubular vessel 4*b*, capillary 6*c* and a starting electrode 8*b* are an integrated body which has been formed by a co-firing process, with the starting electrode 8*b* arranged in a gap between the tubular vessel 4*b* and the capillary 6*c* so that a first end is exposed to the inner space of the tubular vessel 4*b*, a second end is exposed to outside of the tubular vessel 4*b* and a part of the tubular surface of the capillary 6*c* is covered with the composite electrode 8*b*.

In such a discharge lamp, discharge occurs between the composite electrode 7*c* and a protrusion 19 when the discharge lamp is ignited, where protrusion 19 protrudes into the inner space of the tubular vessel 4*b* so that the protruding direction thereof crosses the central axis of the tubular vessel 4*b*. As a result, the starting voltage of the discharge lamp is reduced due to the discharge.

In this case, the starting electrode has good conductivity and can be easily connected to an outer circuit. Also, the starting electrode can perform a good discharge.

Figure 4:
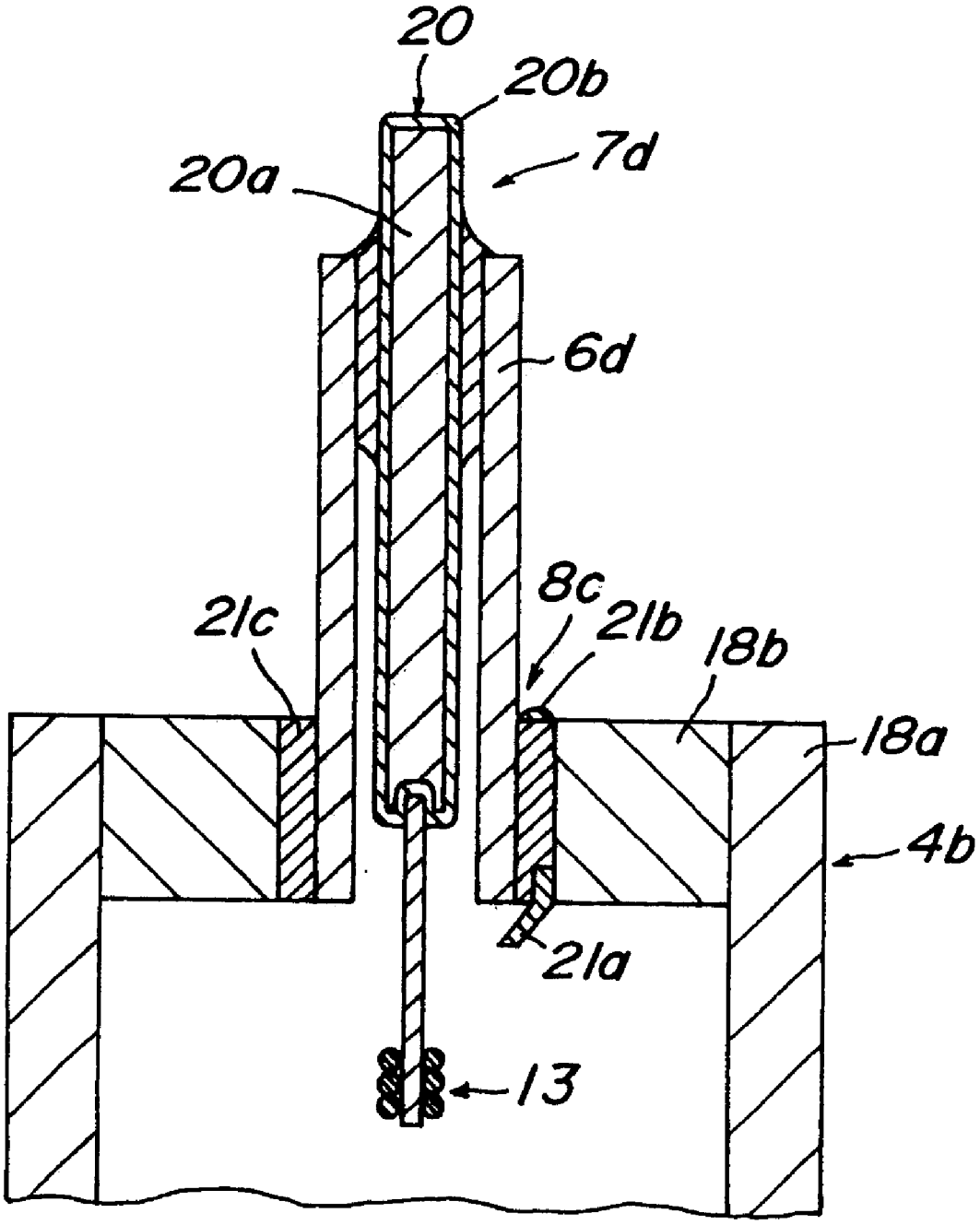

FIG. 4 is a sectional view showing, in an enlarged scale, a third example of one end portion of the vessel in the first embodiment of the present invention. In FIG. 4, a composite electrode 7*d* comprises a current conductor 20, and an electrode 13 buried in a concave portion at the bottom of the current conductor 17 which is exposed to the inner space of the tubular vessel 4*b*. The current conductor 20 has a substantially cylindrical member 20*a* made of alumina, and a metallizing layer 20*b* made of the mixture of alumina and molybdenum. A gap between an opening portion of a capillary 6*d* and the current conductor 20 is sealed by molybdenum and the mixture of molybdenum and alumina contained in the metallizing layer 20*b*.

The starting electrode 8*c* has a metal portion 21 a exposed to the inner space of the tubular vessel 4*b* and a metal portion 21*b* exposed to outside of the tubular vessel. A mixture portion 21*c* composed of alumina and molybdenum covers the inner surface of a disc 18*b*. The starting electrode 8*c*. the tubular vessel 4*b* and a capillary 6*d* are an integrated body which has been formed by a co-firing process, with the starting electrode 8*c* arranged in a gap between the tubular vessel 4*b* and the capillary 6*d*.

In such a discharge lamp, discharge occurs between a composite electrode 7*d* and the metal portion 21*a*.

In this case, a strongly jointed structure is formed among the starting electrode 7*d*, the tubular vessel 4*b* and the capillary 6*d*, so that the discharge lamp has a full tightness property while maintaining full conductivity. Also, the starting electrode can be easily connected to an outer circuit and a good discharge by the starting electrode can be performed.

Figure 5:
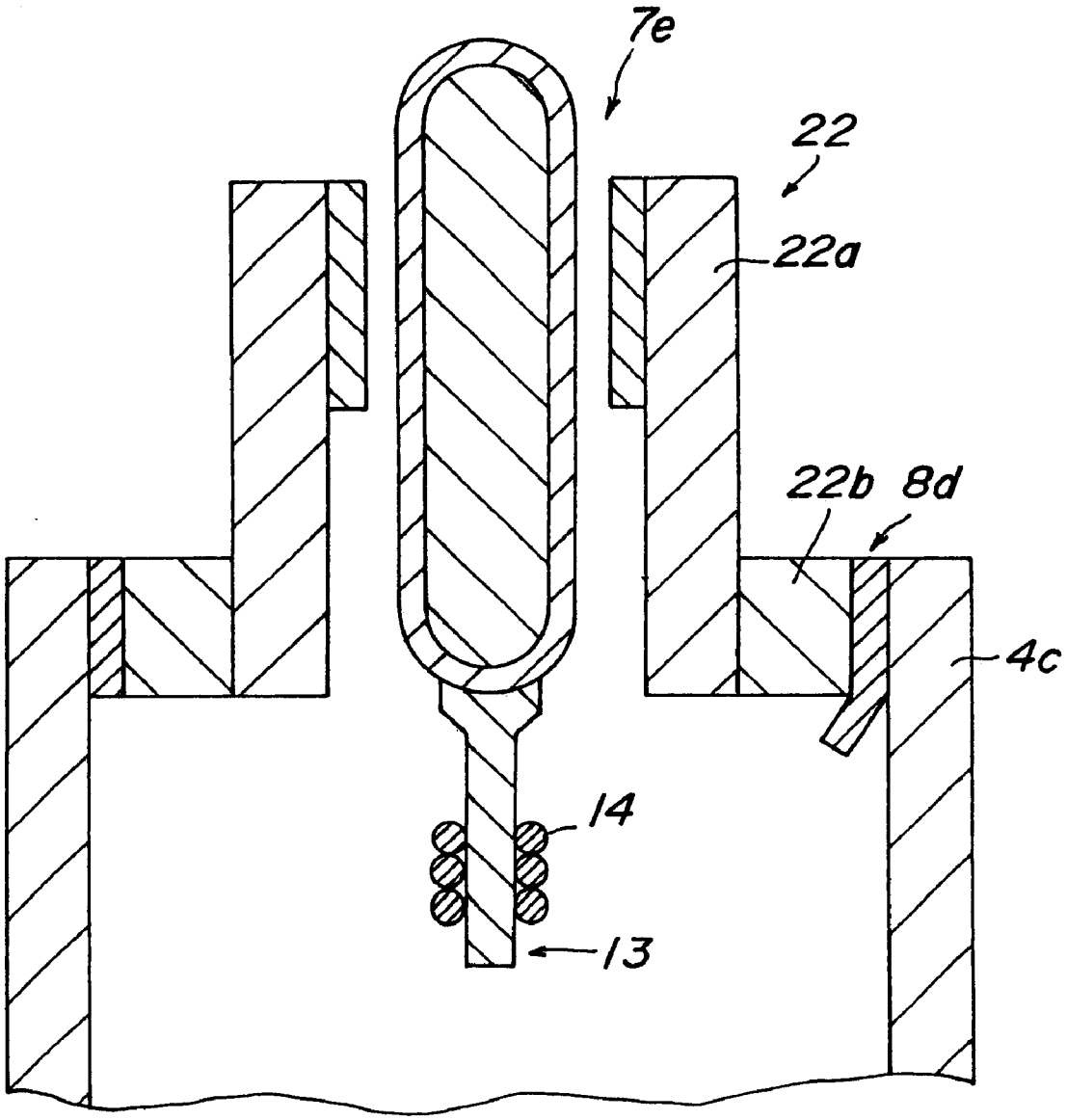

FIG. 5 is a sectional view showing, in enlarged scale, a fourth example of one end portion of the vessel in the first embodiment of the present invention. In FIG. 5, a starting electrode 8*d* composed of a mixture of molybdenum and alumina, a non-conductive body 22 formed by a capillary 22*a* and a disc 22*b*, and a tubular vessel 4*c* are an integrated body formed by a co-firing process. A with the starting electrode 8*d* is arranged in a gap between the disc 22*b* and the tubular vessel 4*c*. A gap between the composite electrode 7*e* and the capillary 22*a* is sealed by welding.

In such a way, the starting electrode 8*d*, the tubular vessel 4*c* and the disc 22*b* have been subjected to a co-firing into an integrated body, with the starting electrode 8*d* arranged in a gap between the tubular vessel 4*c* and the disc 22*b*.

Figure 6:
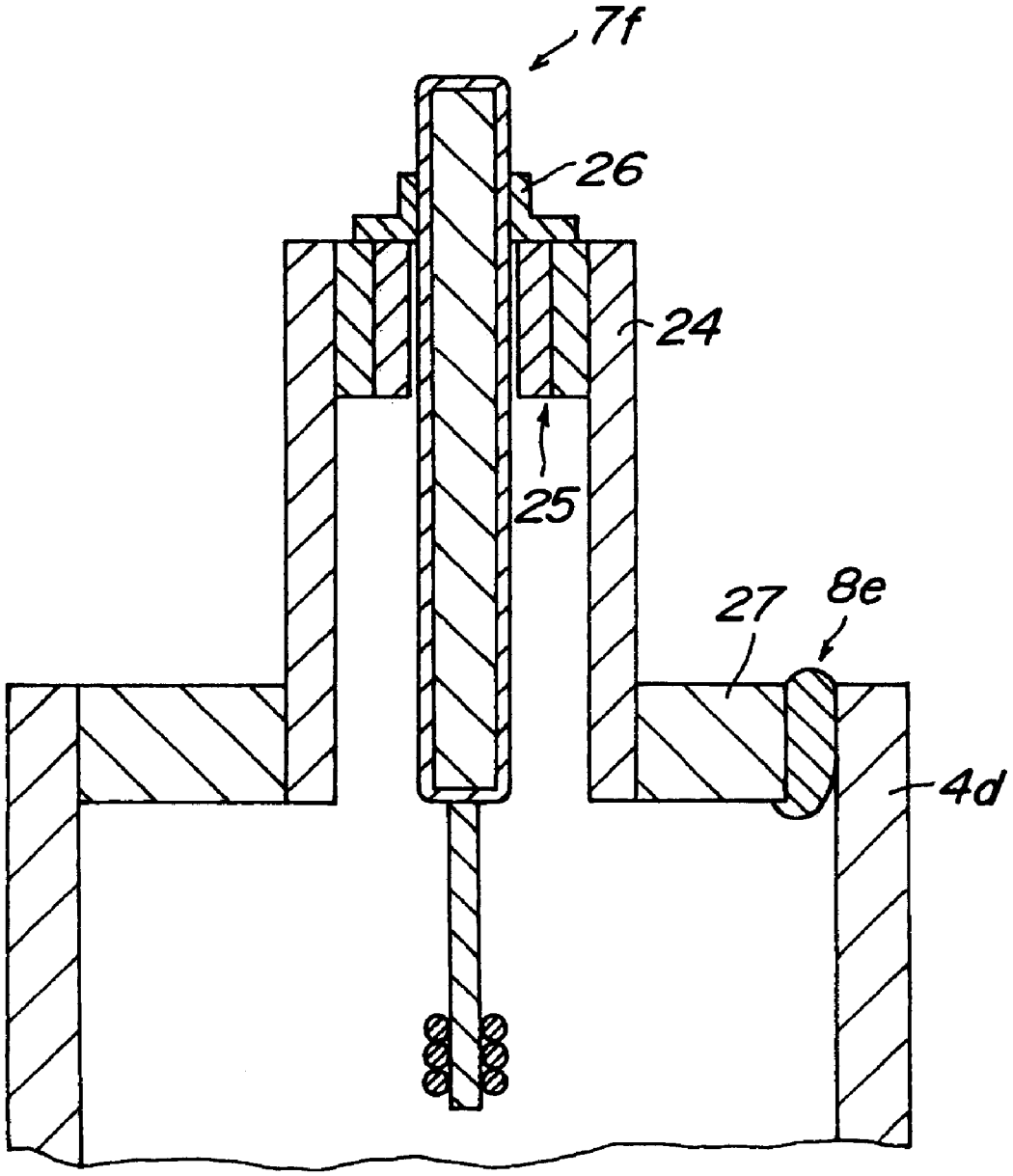

FIG. 6 is a sectional view showing, in enlarged scale, a fifth example of one end portion of the vessel in the first embodiment of the present invention. In FIG. 6, a metallizing layer 25 is formed within a gap between capillary 24 and a composite electrode 7*f*. The capillary 24 and the composite electrode 7*f* are jointed together with molybdenum 26.

In the embodiment, a tubular vessel 4*d*, the disc 27 and an starting electrode 8*e* made of molybdenum are an integrated body which has been formed by a co-firing process, with the starting electrode 8*e* arranged in a gap between the tubular vessel 4*d* and the disc 27 so that a first end is exposed to the inner space of the tubular vessel 4*d*, a second end is exposed to outside of the tubular vessel 4*d*, and the starting electrode 8*e* covers a part of the tubular surface of the disc 27.

Figure 7:
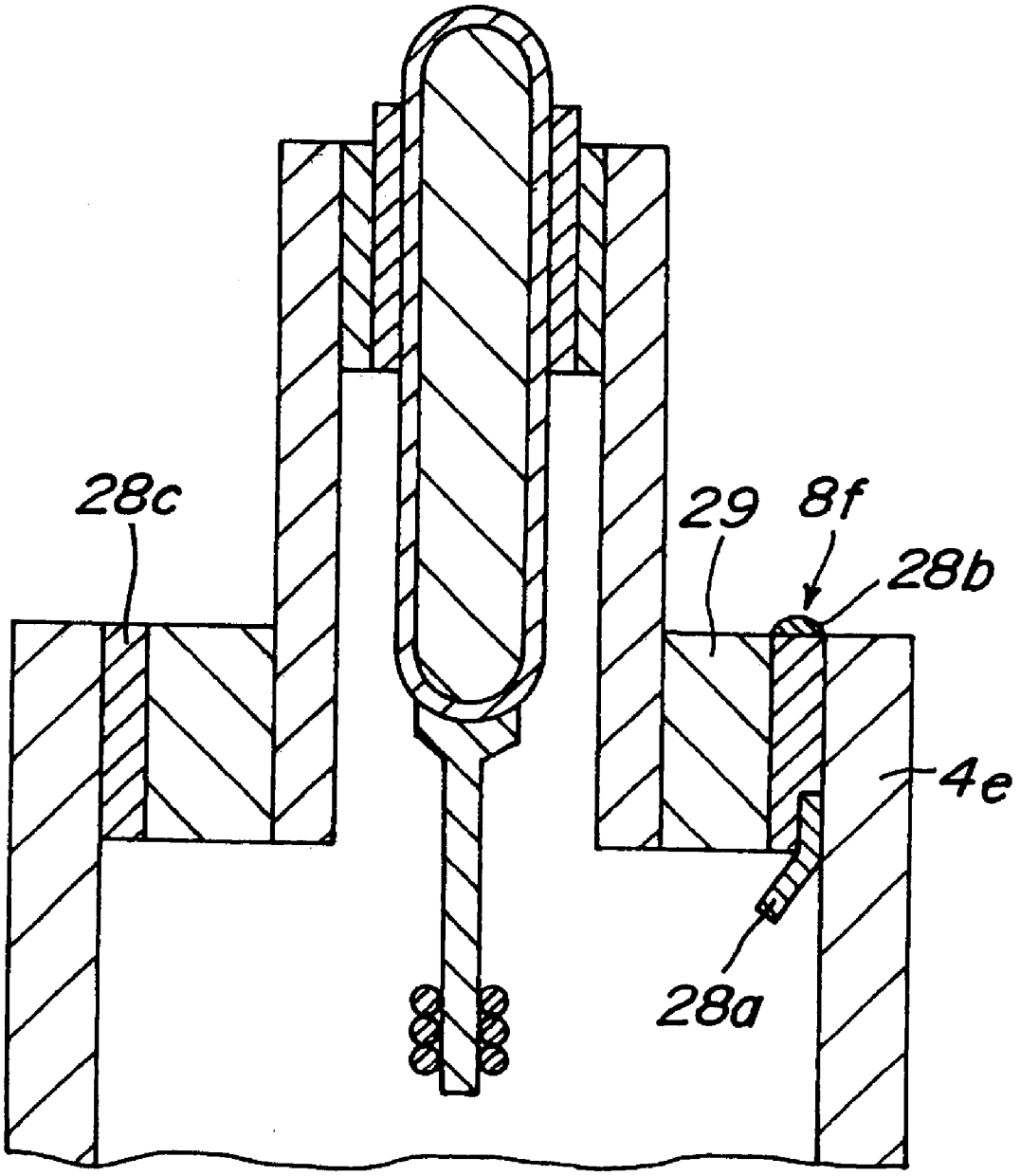

FIG. 7 is a sectional view showing, in enlarged scale, a fifth example of one end portion of the vessel in the first embodiment of the present invention. In FIG. 7. a starting electrode 8*f* has a metal portion 28*a* exposed to the inner space of the tubular vessel 4*e* and a metal portion 28*b* exposed to outside of the tubular vessel 4*e*. A mixture portion 28*c* composed of alumina and molybdenum covers the tubular surface of the disc 18*b*. The starting electrode 8*f*, the tubular vessel 4*e* and a disc 29 are an integrated body which has been formed by a co-firing process, with the starting electrode 8*f* arranged in a gap between the tubular vessel 4*e* and the disc 29.

Figure 8:
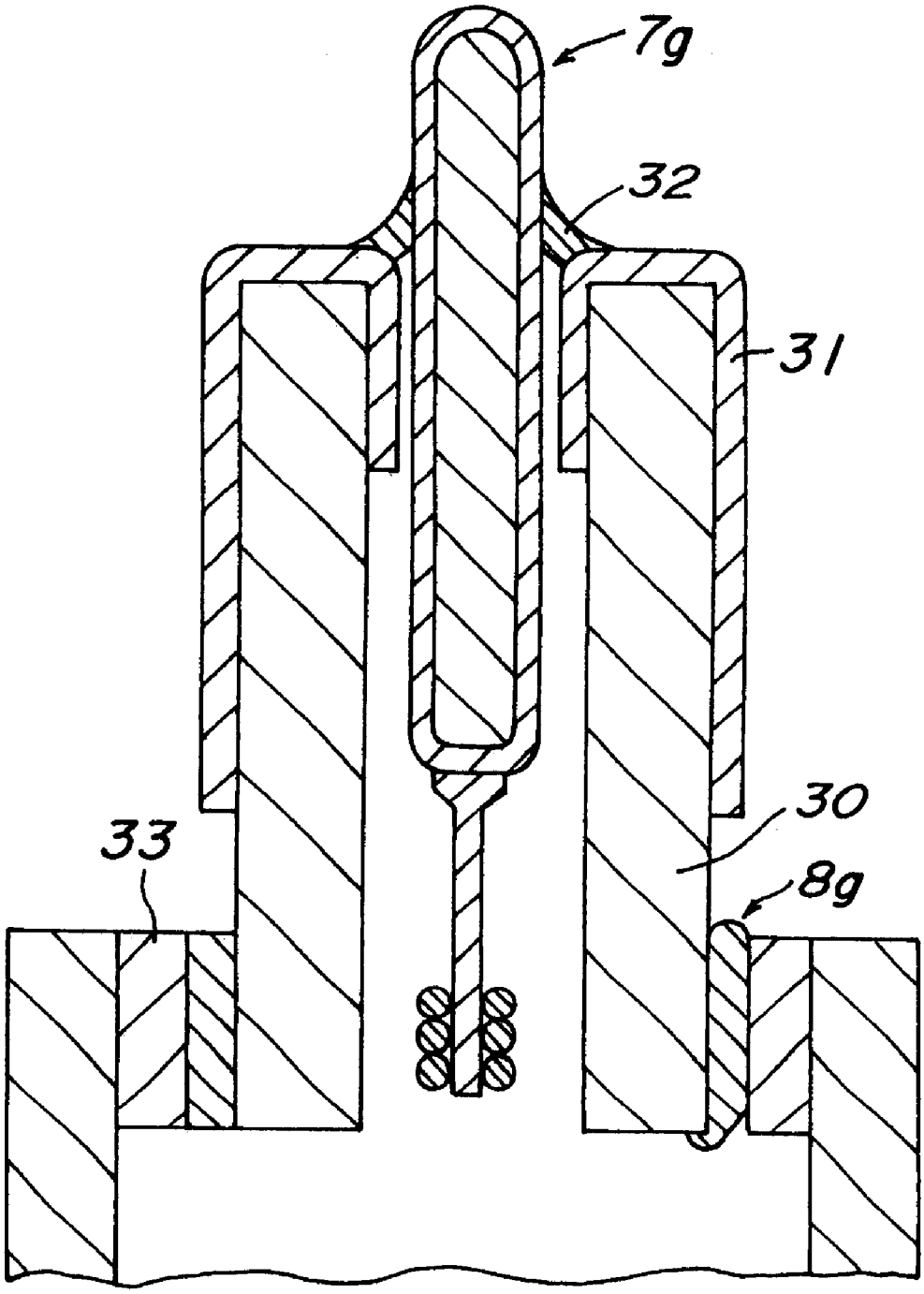

FIG. 8 is a sectional view showing, in enlarged scale, a seventh example of one end portion of the vessel in the first embodiment of the present invention. In FIG. 8, a layer 32 for melting is provided between an extending conductive layer 31 for earth on a capillary 30 and a composite electrode 7*g*. The capillary 30, the starting electrode 7*g* composed of alumina and molybdenum, and a disc 33 are an integrated body which has been formed by a co-firing process, with the starting electrode 7*g* covering over the inner surface of the disc 33.

Figure 9:
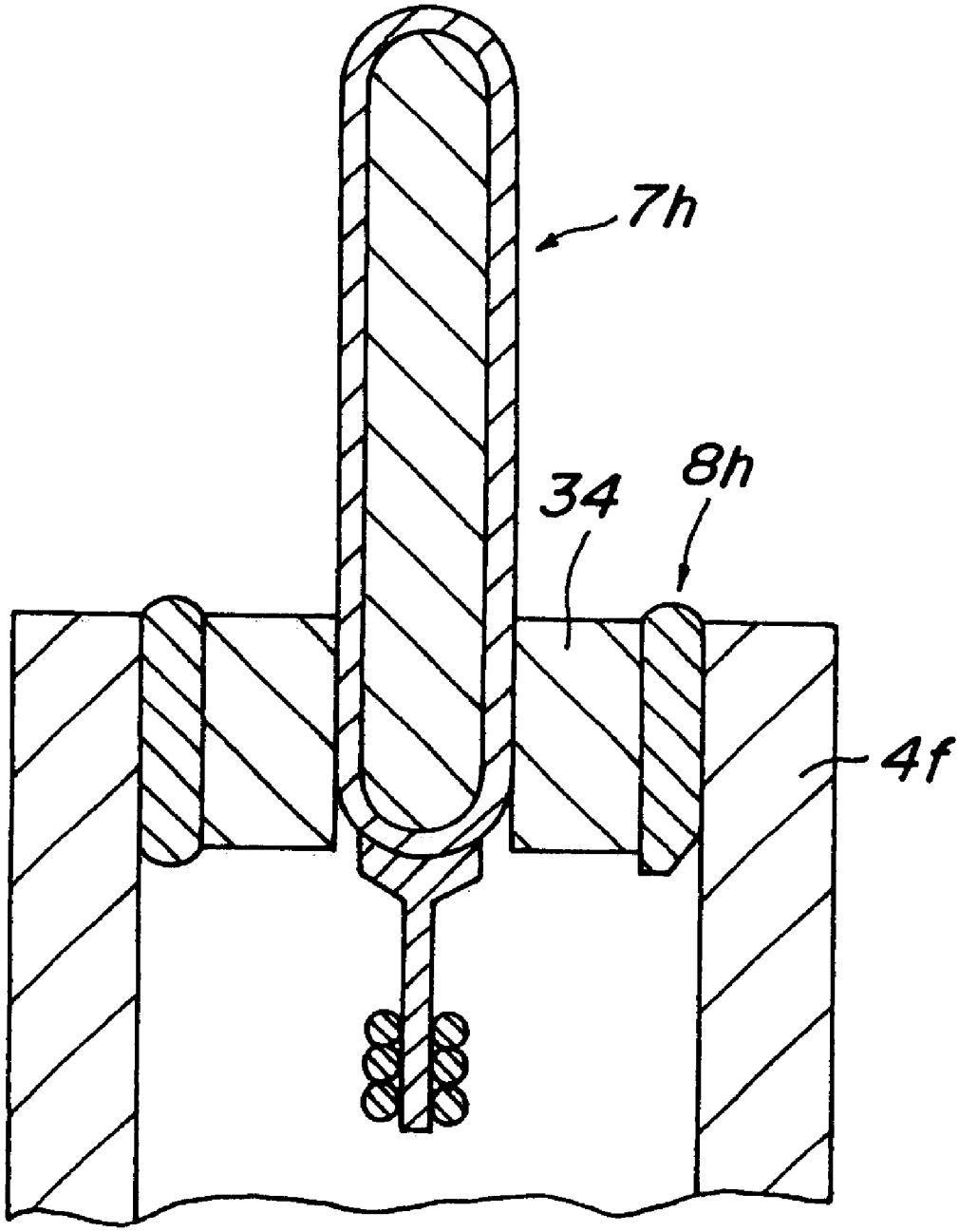

FIG. 9 is a sectional view showing, in enlarged scale, an eighth example of one end portion of the vessel in the first embodiment of the present invention. In FIG. 9, a composite electrode 7*h* is formed by a cylindrical member made of alumina which is provided with a layer of a mixture of molybdenum and alumina, and a disc 34 which have been co-fired into an integrated body with the cylindrical member. Also, the disc 34, starting electrode 8*h* made of a mixture of alumina and molybdenum, and an tubular vessel 4*f* are an integrated body which has been formed by a co-firing process, with the starting electrode 8*h* covering over the tubular surface of the disc 34.

Figure 10:
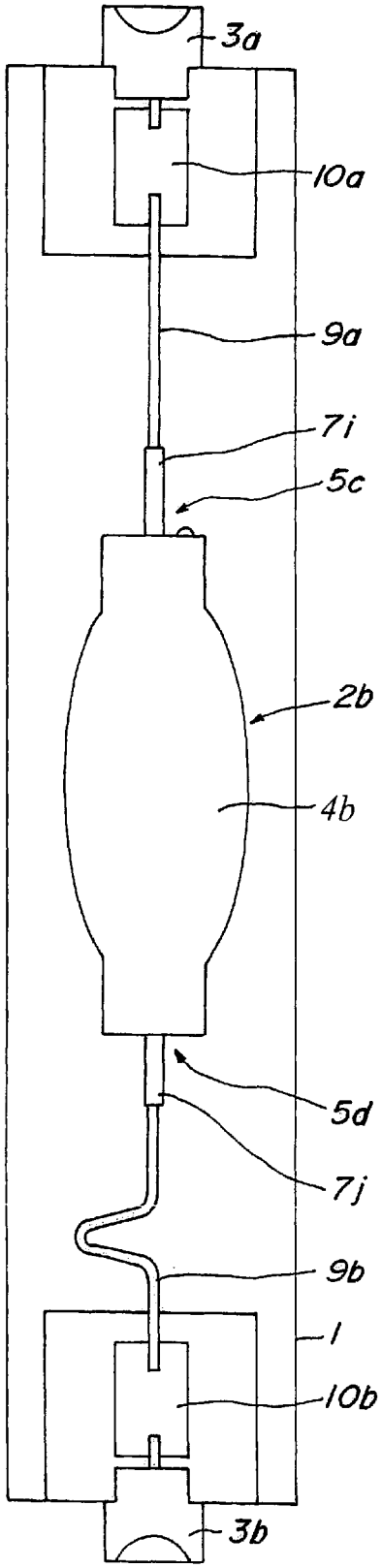
FIG. 10 is a schematic view showing a second embodiment of the high pressure discharge lamp according to the present invention.
Figure 11:
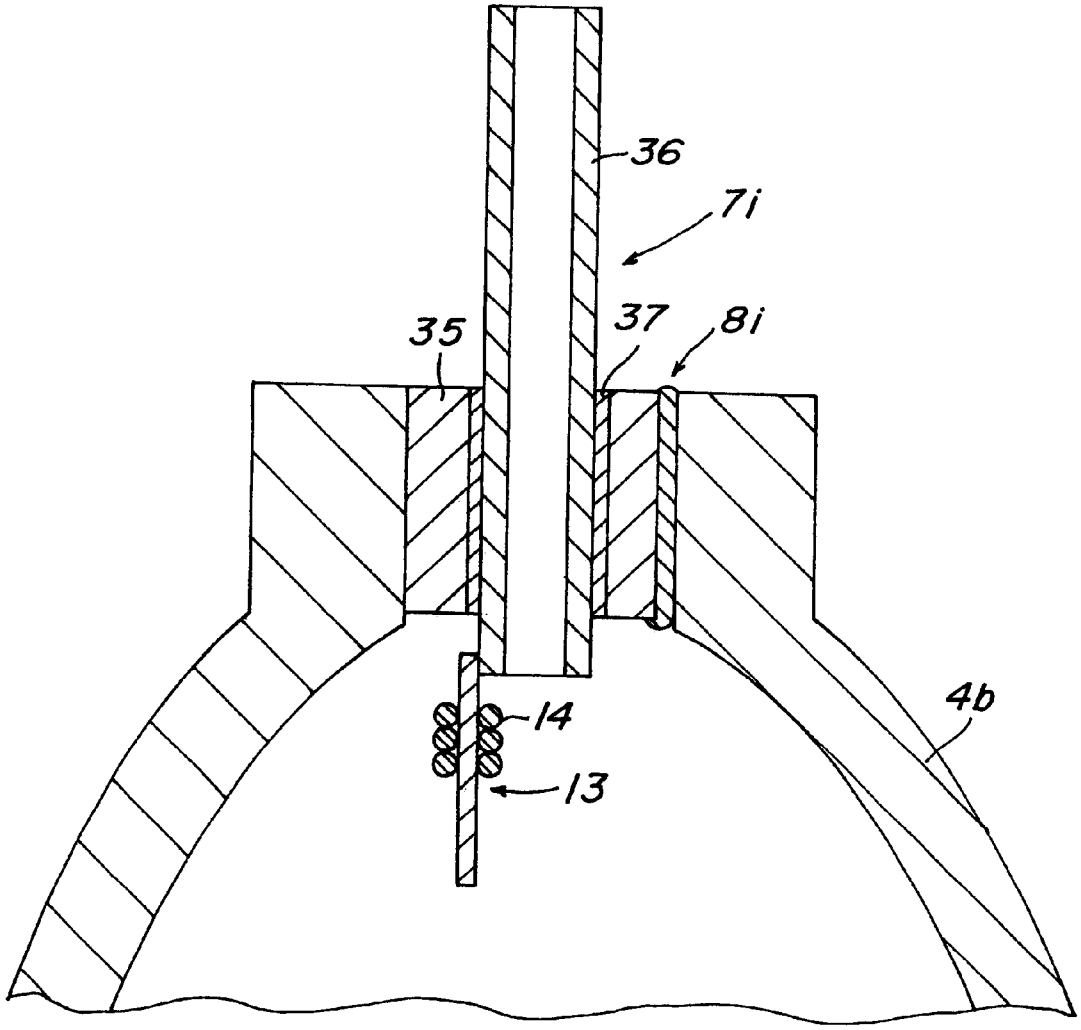
FIGS. 11 to 15 are sectional views showing, in enlarged scale, various examples of one end portion of the vessel in the second embodiment of the present invention.

FIG. 10 is a plane view for schematically showing a second embodiment of the entire structure of the high pressure discharge lamp, and FIG. 11 is a sectional view showing, in enlarged scale, a first example of one end portion of the vessel in the second embodiment of the present invention. In FIGS. 10 and 11, a ceramic discharge tube 2*b* has a barrel shaped vessel 4*b* made of alumina, a disc 35 made of alumina which has a through-hole, and composite electrodes 7*i* and 7*j*, instead of the vessel 4*a*, capillaries 6*a*. 6*b* and composite electrodes 7*a*, 7*b* (FIGS. 1 and 2).

In the embodiment, at one end portion 5*c*, the barrel shaped vessel 4*b*, a disc 35 and a starting electrode 8*i* made of molybdenum are an integrated body which has been formed by a co-firing process, with the starting electrode 8*i* arranged a gap between the barrel shaped vessel 4*b* and the disc 35 so that a first is exposed to the inner space of the barrel shaped vessel 4*b* and a second end is exposed to outside of the barrel shaped vessel 4*b*.

In FIG. 11, the composite electrode 7*i* has a tubular electrode unit-holding member 36 made of molybdenum inserted into a through-hole of the disc 35, and an electrode 13 jointed at the bottom of the electrode unit-holding member 36 exposed to the inner space of the barrel shaped vessel 4*b*. At the end of the electrode-holding member 36 exposed outside of the barrel shaped vessel 4*b*, an opening portion sealed by laser welding or TIG welding after the ionizable light-emitting material and the starting gas are charged into the inner space of the barrel shaped vessel 4*b*, is provided. A gap between the disc 35 and the electrode unit-holding member 36 is tightly sealed by a metallizing layer 37.

Figure 12:
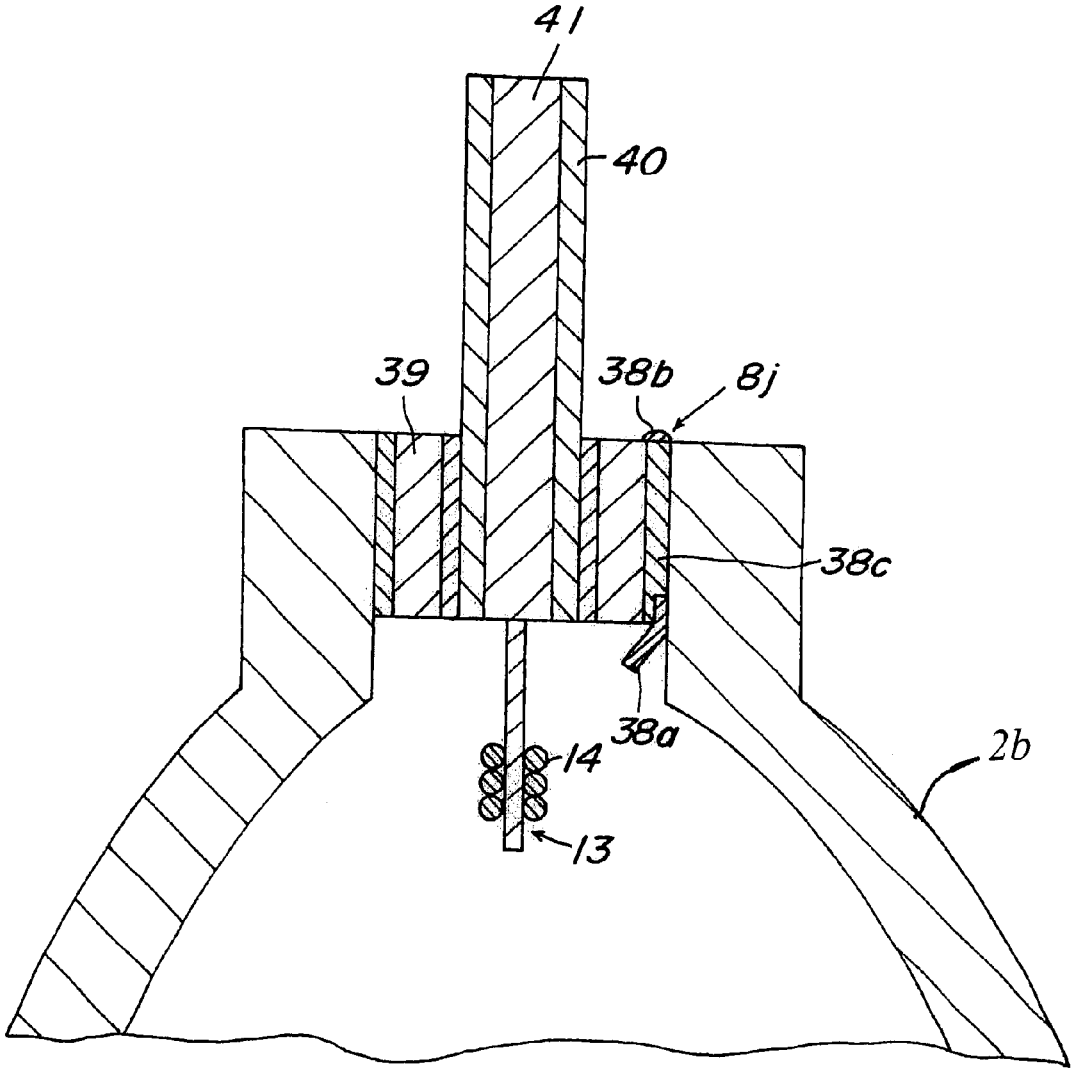

FIG. 12 is a sectional view showing, in enlarged scale, a second example of one end portion of the vessel in the second embodiment of the present invention. In FIG. 12, a starting electrode 8*j* has a metal portion 38*a* exposed to the inner space of a ceramic discharge tube 4*b*, a metal portion 38*b* exposed to outside of the ceramic discharge tube 4*b*, and a mixture portion 38*c* covering over a tubular surface of a disc 39. The mixture portion 38*c* is also composed of alumina and molybdenum, and contains 30 to 70 volumetric percentage of molybdenum. An electrode unit-holding member 41 connected to an electrode 13 directly, is inserted into a tubular conductive member 40 inserted into the through-hole of the disc 39. This application method is disclosed in JP-A-6-3188435, to be concrete, outer ends of the tubular member 40 and the electrode unit-holding member 41 are welded together.

Figure 13:
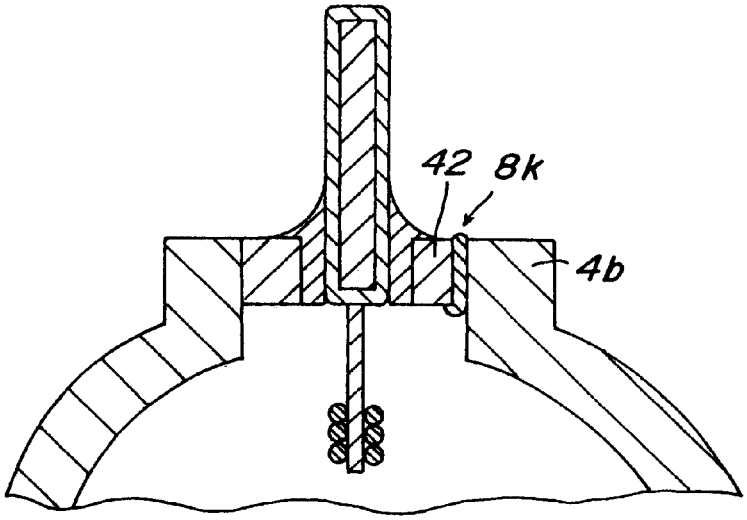

FIG. 13 is a sectional view showing, in enlarged scale, a third example of one end portion of the vessel in the second embodiment of the present invention. In FIG. 13, a barrel shaped vessel 4*b*, a disc 42 and a starting electrode 8*k* are an integrated body which has been formed by a co-firing process, with the starting electrode 8*k* arranged in a gap between the barrel shaped vessel 4*b* and the disc 42 so that a first end is exposed to the inner space of the barrel shaped vessel 4*b* and a second end is exposed to outside of the barrel shaped vessel 4*b*.

Figure 14:
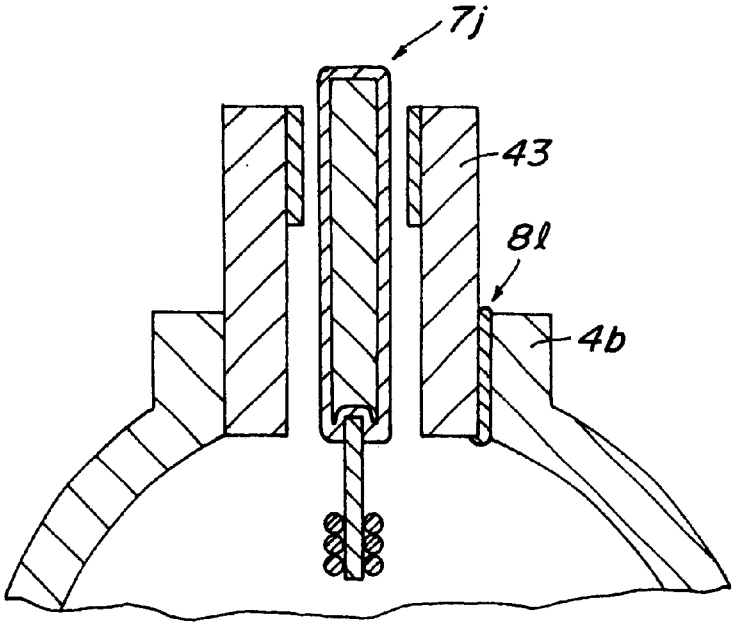

FIG. 14 is a sectional view showing, in enlarged scale a fourth example of one end portion of the vessel in the second embodiment of the present invention. In FIG. 14, a starting electrode 81 made of a mixture of alumina and molybdenum, is provided so that a first end is exposed to the inner space of the barrel shaped vessel 4*b*, a second end is exposed outside of the barrel shaped vessel 4*b*, a part of the inner surface of the barrel shaped vessel 4*b* is covered with the starting electrode 81, and a part of the tubular surface of capillary 43 is covered with the starting electrode 81. A gap between the composite electrode 7*j* and the capillary 43 is tightly welded. In such a way, the starting electrode composed of a mixture of alumina and molybdenum can be provided so as to cover a part of a tubular surface of a non-conductive body (i.e. the capillary 43).

Figure 15:
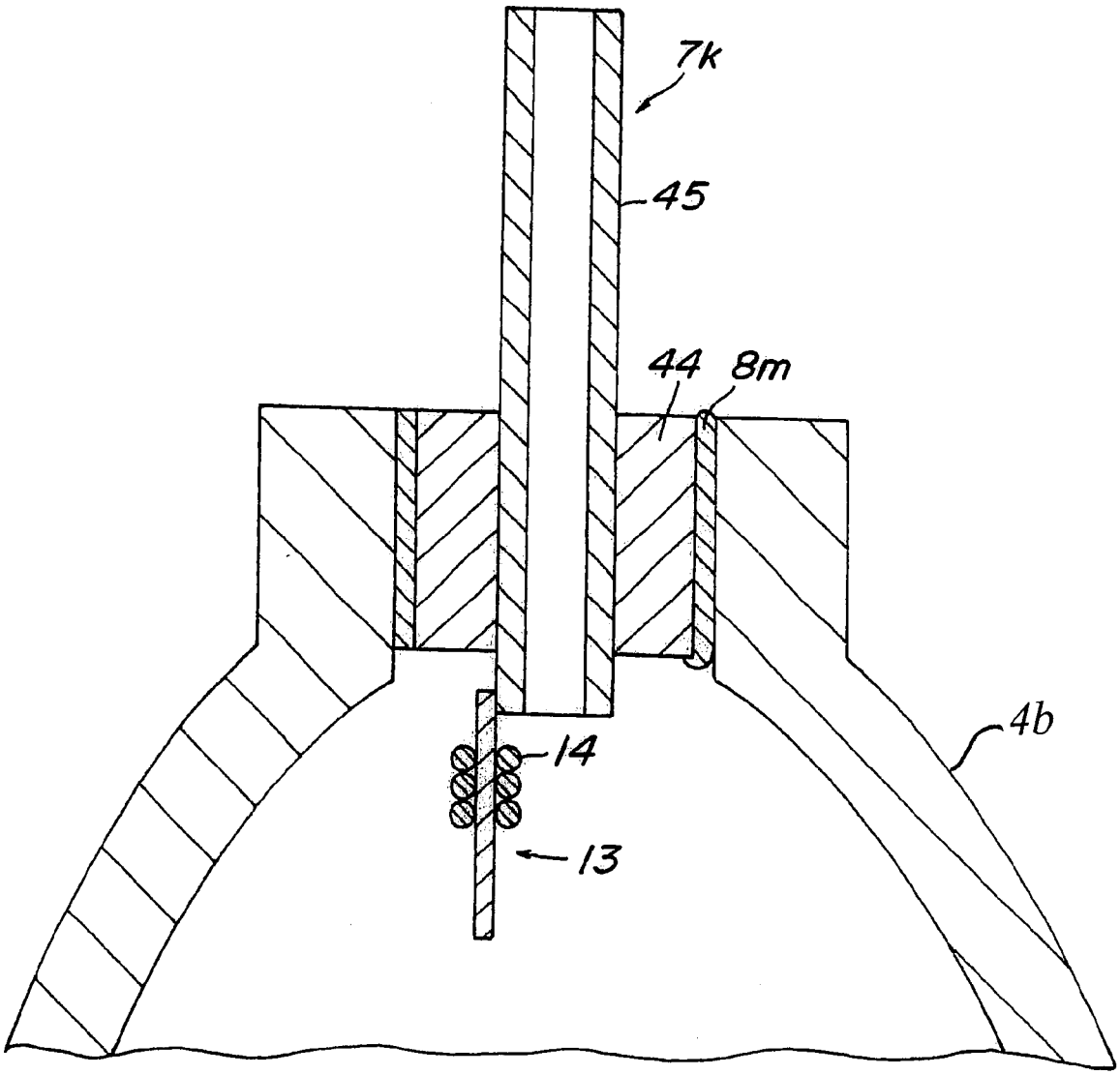

FIG. 15 is a sectional view showing, in enlarged scale, a fifth example of one end portion of the vessel in the second embodiment of the present invention. In FIG. 15, a composite electrode 7*k* has a tubular electrode unit-holding member 45 made of molybdenum which is inserted into a through-hole of a disc 44, and an electrode 13 jointed at the bottom of electrode unit-holding member 45 which is exposed to the inner space of the barrel shaped vessel 4*b*. At the end of the electrode-holding member 45 exposed outside of the barrel shaped vessel 4*b*, an opening portion sealed by laser welding or TIG welding after the ionizable light-emitting material and the starting gas are charged into the inner space of the barrel shaped vessel 4*b*, is provided.

In the embodiment, the barrel shaped vessel 4*b*, the disc 44 and an starting electrode 8*m* are an integrated body which has been formed by a co-firing process, with the starting electrode 8*m* arranged in the barrel shaped vessel 4*b* and the disc 44 so that a first end is exposed to the inner space of the barrel shaped vessel 4*b*, a second end is exposed to outside of the barrel shaped vessel 4*b*, and the starting electrode covers over the tubular surface of the disc 44.

Next, a method of manufacturing the high pressure discharge lamp is described.

Figure 16:
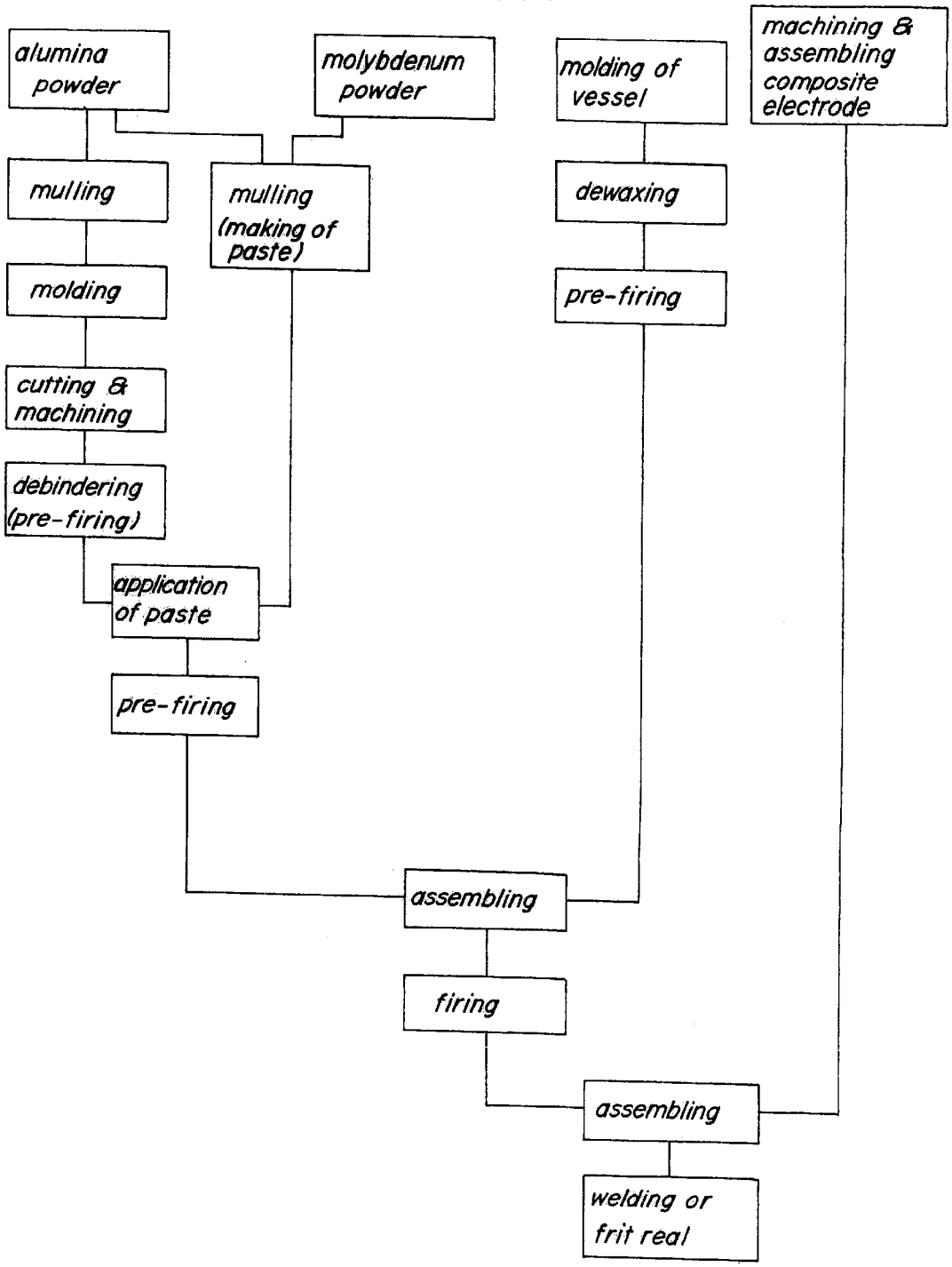
FIGS. 16 to 21 are flow charts illustrating the process for manufacturing the high pressure discharge lamp of the present invention.

FIG. 16 is a flowchart illustrating the process for manufacturing the high pressure discharge lamp of the present invention. In this process, first, alumina powder is mulled and extrusion molded, press molded or cast molded to obtain a molded body, and then, the molded body is cut and processed. In this case, the process is mainly an outer peripheral process (centerless or the like), and the cutting can be done in advance of the processing or the processing can be done in advance of the cutting. Then, a binder is removed from the molded body, and the body is pre-fired by the request to obtain the pre-fired body of a non-conductive member (i.e. a capillary, a disc or both of them).

Next, the pre-fired body is applied with a paste of the alumina powder and the molybdenum powder, and the body formed as such is pre-fired.

On the other hand, a vessel (i.e. a tubular vessel, a barrel shaped vessel or a main body thereof) is molded, the molded body formed as such is dewaxed and pre-fired to obtain the pre-fired body of the vessel. The pre-fired body formed as such and the pre-fired body of the non-conductive member applied with a paste of the molybdenum powder are assembled and fired to obtain a fired body of the vessel and the non-conductive member having a starting electrode, with a first end exposed to the inner space of the vessel and a second end exposed outside of the vessel.

Also, the composite electrode is processed and assembled at the same time of these steps, or before or after the steps, and the composite electrode and the fired body of the vessel and the non-conductive member arc assembled, and a gap between the composite electrode and the fired body is welded or filled with frit seal.

Figure 17:
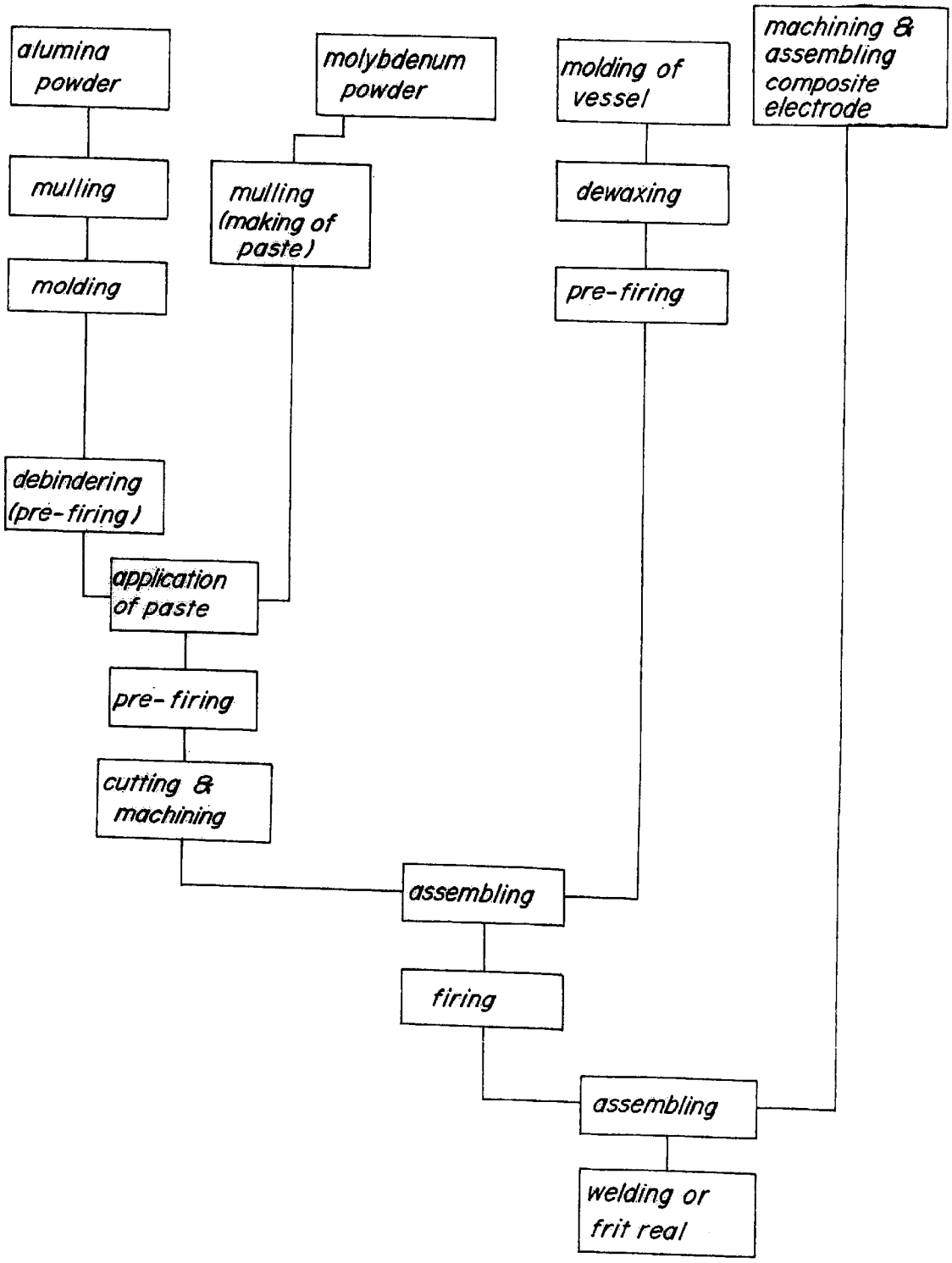

FIG. 17 is another flowchart illustrating the process for manufacturing the high pressure discharge lamp of the present invention. In this case, the cutting and processing is carried out after the firing or calcining step of the non-conductive member instead of performing the cutting and processing after the extrusion molding.

Figure 18:
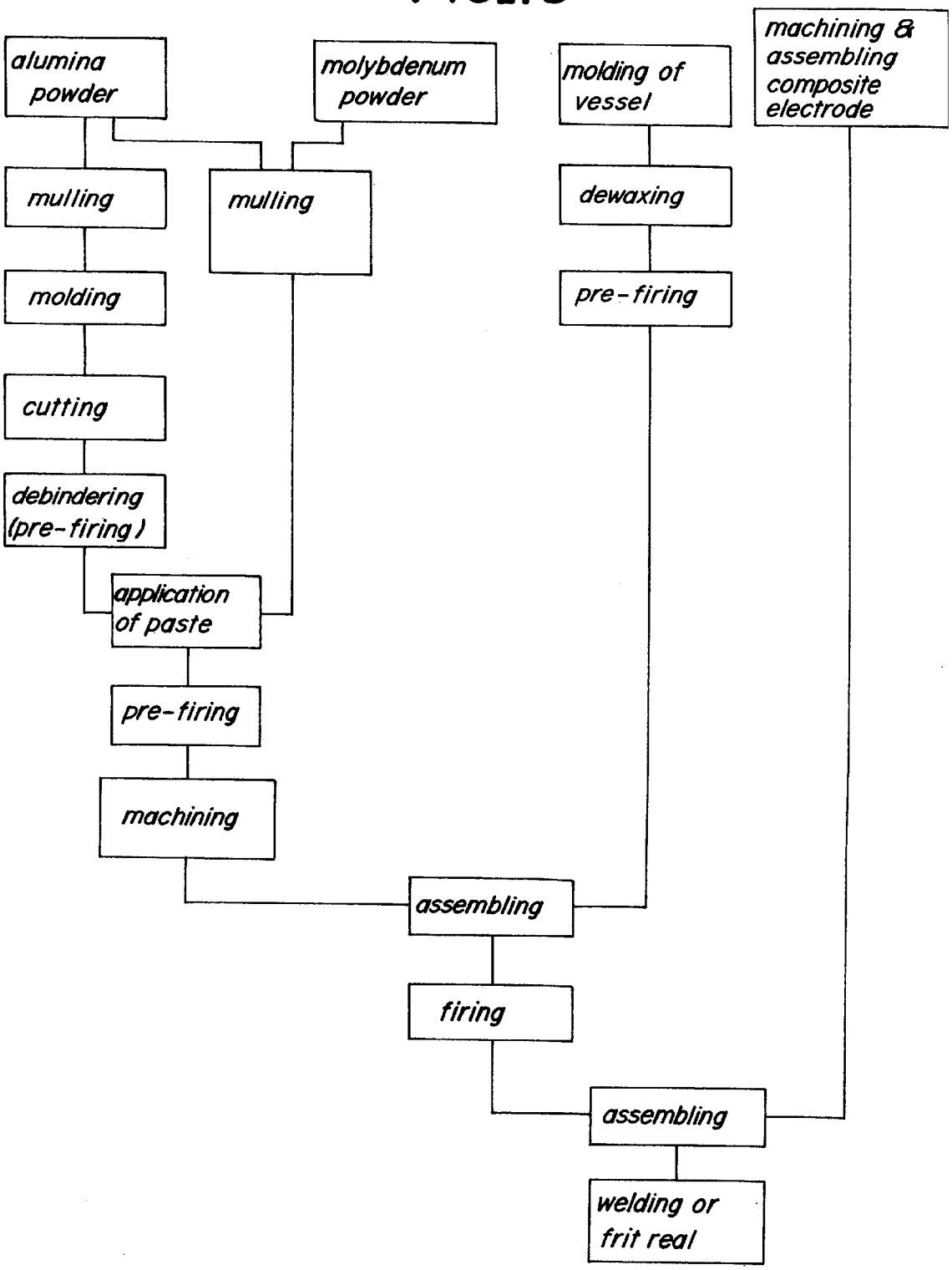
Figure 19:
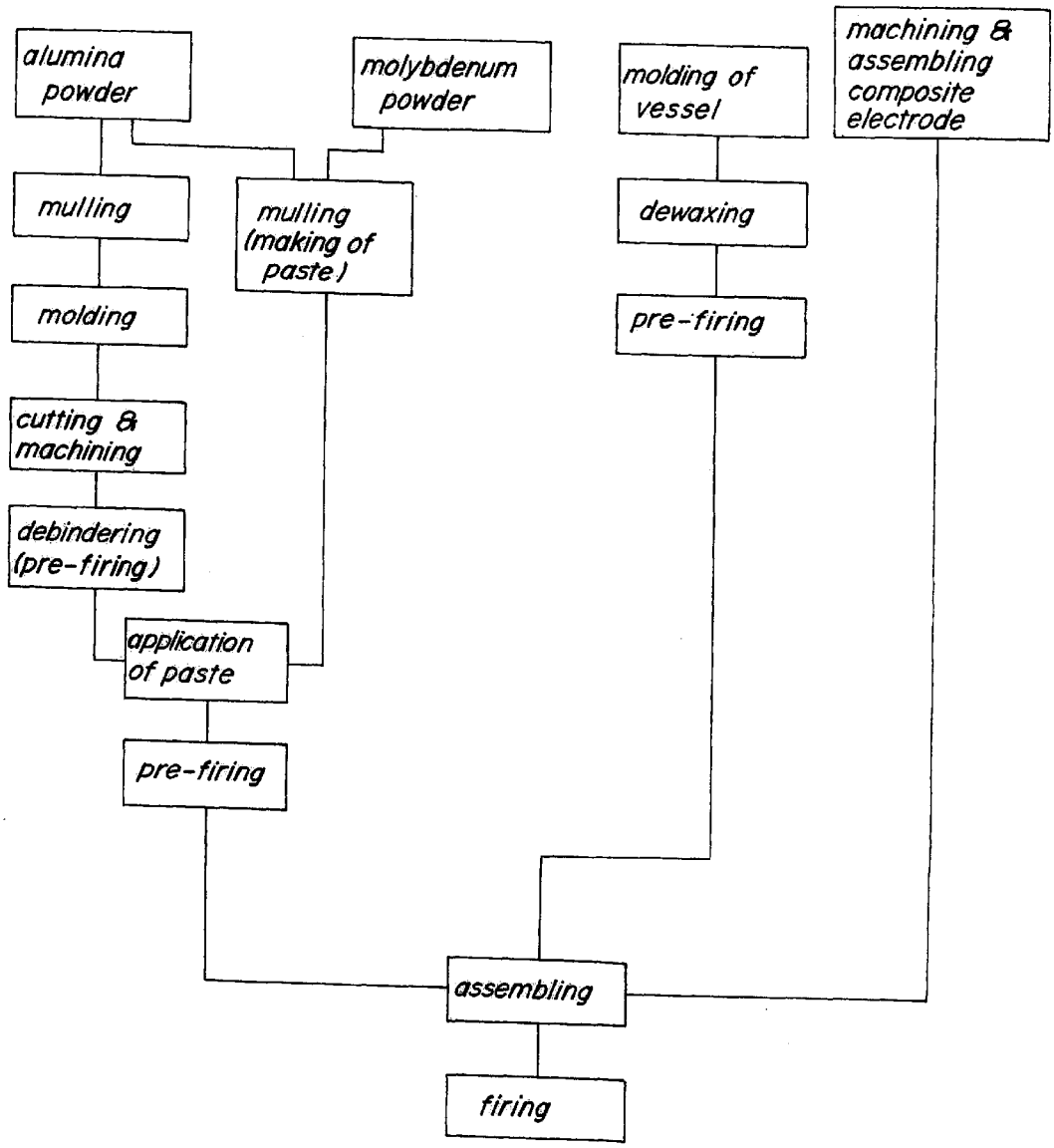
Figure 20:
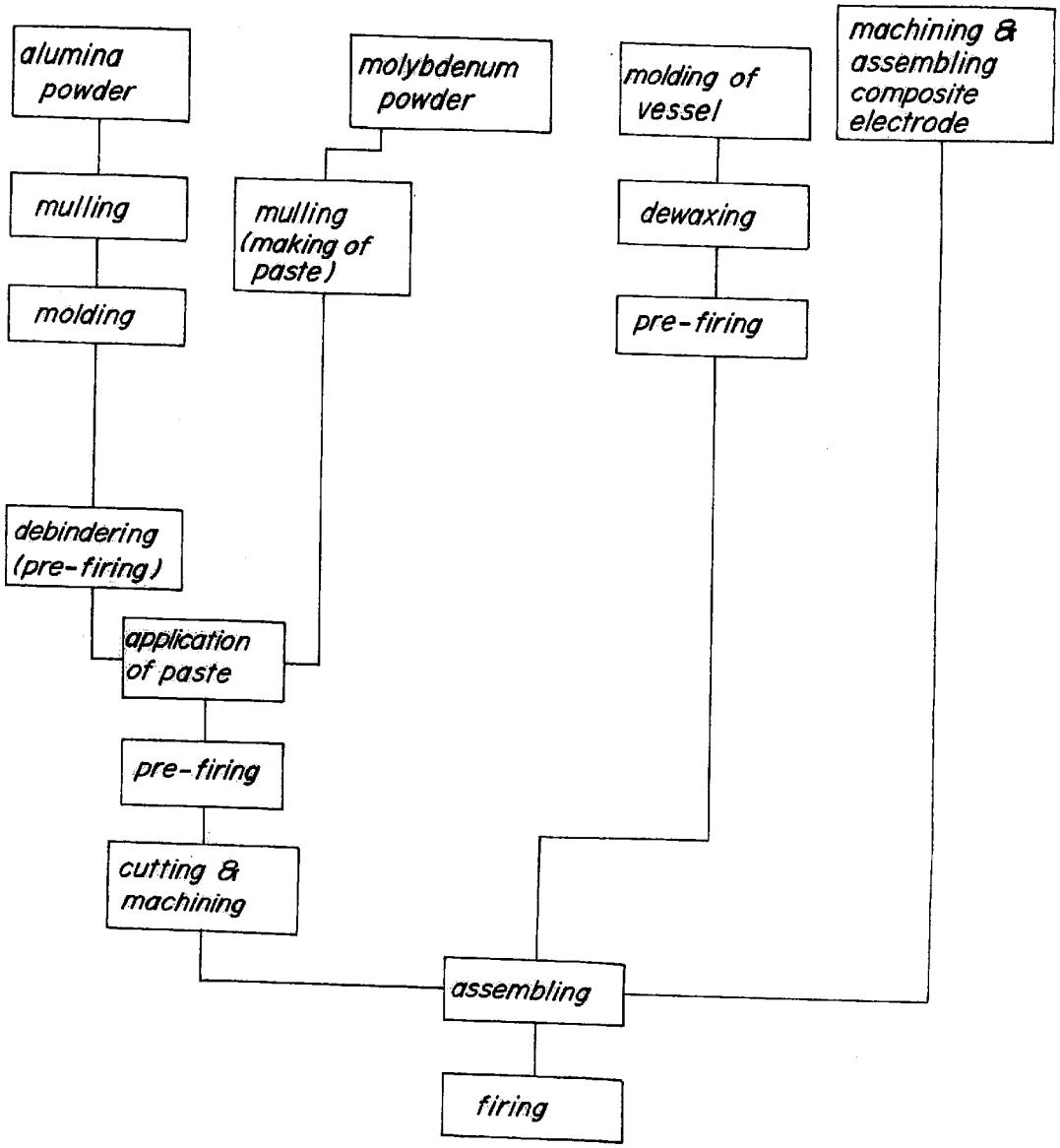
Figure 21:
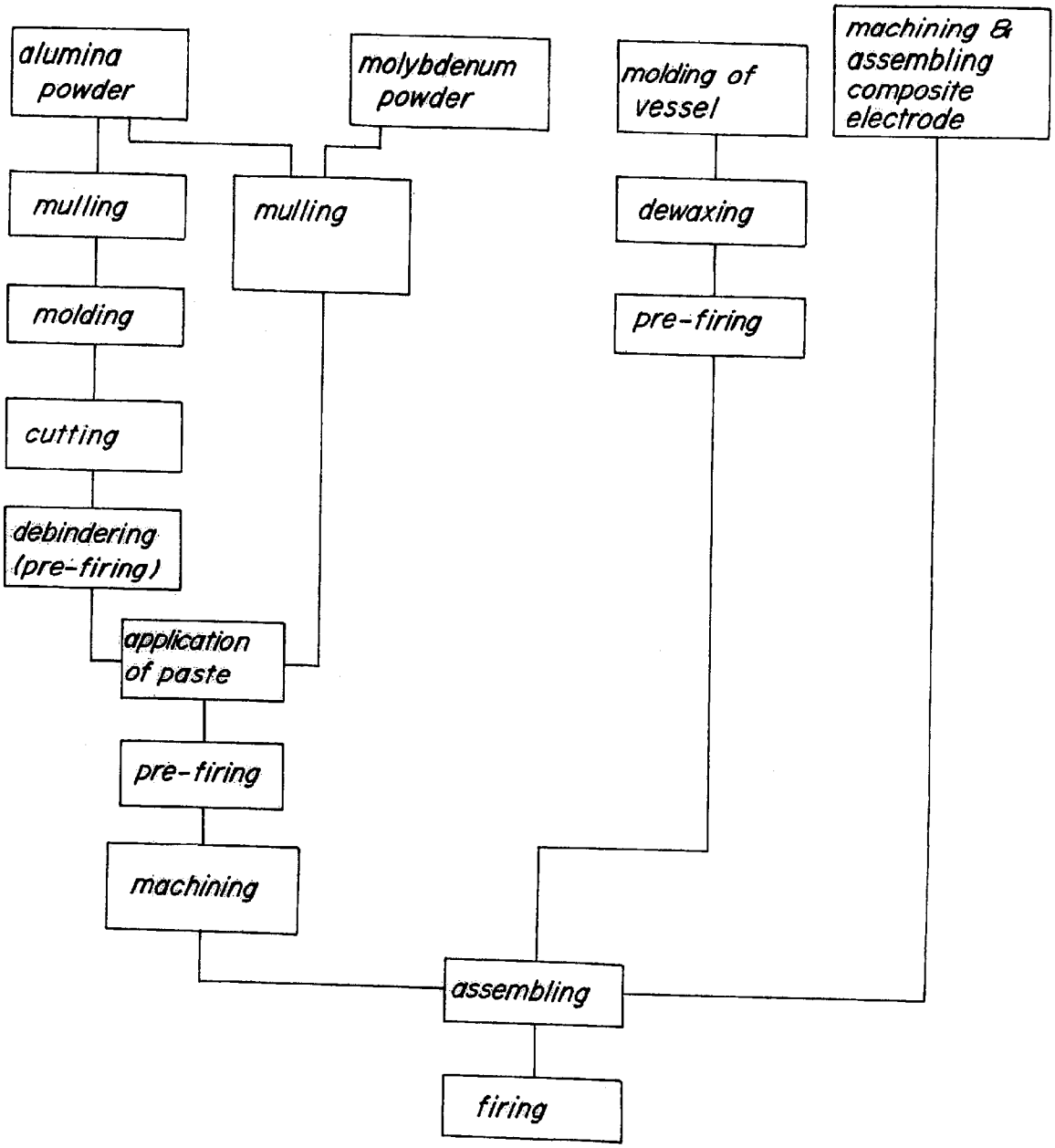

FIGS. 19 to 21 show alternative examples of the flow charts shown in FIGS. 16 to 18, respectively. In those flow charts, a composite electrode composed of a cylindrical member made of alumina on which a layer made of a mixture of molybdenum and alumina is provided, is used. The pre-fired body of the non-conductive member, the pre-fired body of the vessel and the composite electrode are co-fired into an integrated body after the pre-fired body of the non-conductive member, the pre-fired body of the vessel and the composite electrode are assembled.

While the present invention has been described above with reference to certain preferred embodiments, it should be noted that they were presented by way of examples only and various changes and/or modifications may be made without departing from the scope of the invention. For example, a non-conductive material other than alumina (e.g. cermet) can be used as a material of the vessel and the non-conductive member. Also, the vessel and the non-conductive member is formed by a same material, however the material forming the vessel can be different from that forming the non-conductive member (For example, the vessel is made of alumina and the non-conductive member is made of cermet.).

The vessel may take any other form than the tubular form or the barrel form. The electrode does not have to have the coil. In the above embodiment, the composite electrode or the metal portion is made of molybdenum, however it can be any other metal (e.g. niobium or the like) than molybdenum.

In manufacturing the discharge lamp of the present invention, after firing or calcining the vessel and the non-conductive member, these fired or pre-fired body formed as such are assembled with the composite electrode and these are fired, however, after firing or calcining the non-conductive member and the composite electrode, these fired or pre-fired body formed as such are assembled with the vessel and these are fired.

What is claimed is:

1. A high pressure discharge lamp comprising:

a vessel made of a non-conductive material which forms an inner space filled with an ionizable light-emitting material and a starting gas, said vessel having first and second opening portions at opposite ends thereof, respectively;

a non-conductive member inserted into said first opening portion of the vessel and having an outer diameter which is smaller than an inner diameter of said first opening portion so as to form a gap between the vessel and the non-conductive member, said non-conductive member further having a hole;

an electrode unit inserted into said hole of the non-conductive member, said electrode unit having a first end which is exposed to the inner space of the vessel, and a second end which is exposed to outside of the vessel; and a starting electrode arranged in said gap between the vessel and the non-conductive member, and having a first end which is exposed to the inner space, and a second end which is exposed to outside of the vessel;

said vessel, said non-conductive member and said starting electrode being an integrated body formed by a co-firing process.

2. The discharge lamp according to claim 1, wherein said starting electrode is composed of a metal.

3. The discharge lamp according to claim 1, wherein said starting electrode is composed of a mixture of a non-conductive material and a metal.

4. The discharge lamp according to claim 3, wherein said mixture contains 30 to 70 volumetric percentage of said metal.

5. The discharge lamp according to claim 3, wherein said metal of the mixture contains not less than 50 volumetric percentage of molybdenum;

and said non-conductive material contains not less than 50 volumetric percentage of a material from which the vessel and/or the non-conductive member is formed.

6. The discharge lamp according to claim 5, wherein said metal of the mixture forming the starting electrode comprises molybdenum, and said non-conductive material of the mixture is the same as the non-conductive material for said vessel and said non-conductive member.

7. The discharge lamp according to claim 1, wherein said starting electrode comprises:

an exposed portion which is exposed to said inner space or outside of said vessel, and which is composed of a metal; and a non-exposed portion which is not exposed to said inner space or outside of said vessel, and which is composed of a mixture of a non-conductive material and a metal.

8. The discharge lamp according to claim 7, wherein said mixture contains 30 to 70 volumetric percentage of a metal.

9. The discharge lamp according to claim 7, wherein said metal of the mixture contains not less than 50 volumetric percentage of molybdenum, and said non-conductive material contains not less than 50 volumetric percentage of a material from which the vessel and/or the non-conductive member is formed.

10. The discharge lamp according to claim 9, wherein said metal of the mixture forming the starting electrode comprises molybdenum, and said non-conductive material of said mixture is the same as the non-conductive material for said vessel and said non-conductive member.

11. The discharge lamp according to claim 4, wherein said metal of the mixture contains not less than 50 volumetric percentage of molybdenum; and said non-conductive material contains not less than 50 volumetric percentage of a material from which the vessel and/or the non-conductive member is formed.

12. The discharge lamp according to claim 8, wherein said metal of the mixture contains not less than 50 volumetric percentage of molybdenum; and said non-conductive material contains not less than 50 volumetric percentage of a material from which the vessel and/or the non-conductive member is formed.

13. The discharge lamp according to claim 1, wherein interfaces between said vessel and said starting electrode and between said starting electrode and said non-conductive member contain only materials originating from at least one of said vessel, said starting electrode, and said non-conductive member.

* * * * *